US007561711B2

(12) United States Patent
Hawker et al.

(10) Patent No.: US 7,561,711 B2
(45) Date of Patent: Jul. 14, 2009

(54) AUDIO PERIPHERAL FOR AN ELECTRONIC DEVICE

(75) Inventors: Larry Hawker, Waterloo (CA); George Mankaruse, Kitchener (CA); David Dougall, Waterloo (CA)

(73) Assignee: Research In Motion Limited, Waterloo (CA)

( * ) Notice: Subject to any disclaimer, the term of this patent is extended or adjusted under 35 U.S.C. 154(b) by 504 days.

(21) Appl. No.: 11/229,604

(22) Filed: Sep. 20, 2005

(65) Prior Publication Data

US 2007/0064963 A1 Mar. 22, 2007

(51) Int. Cl.
*H04R 25/00* (2006.01)

(52) U.S. Cl. ..... 381/331; 381/315; 379/441

(58) Field of Classification Search ..... 381/331, 381/312, 315; 379/447–450
See application file for complete search history.

(56) References Cited

U.S. PATENT DOCUMENTS

| | | | | |
|---|---|---|---|---|
| 5,557,673 | A * | 9/1996 | Ginzburg | 379/443 |
| 6,078,675 | A * | 6/2000 | Bowen-Nielsen et al. | 381/331 |
| 6,157,728 | A * | 12/2000 | Tong et al. | 381/331 |
| 6,320,959 | B1 * | 11/2001 | Crouch et al. | 379/430 |
| 6,438,245 | B1 | 8/2002 | Taenzer | |
| 6,639,564 | B2 * | 10/2003 | Johnson | 343/702 |
| 7,043,041 | B2 * | 5/2006 | Švajda et al. | 381/331 |
| 7,317,807 | B1 * | 1/2008 | Waldron | 381/331 |
| 2003/0044033 | A1 | 3/2003 | Julstrom | |
| 2003/0097037 | A1 | 5/2003 | Miller | |
| 2004/0203345 | A1 | 10/2004 | Tehrani | |
| 2004/0240692 | A1 * | 12/2004 | Julstrom | 381/315 |
| 2005/0089186 | A1 * | 4/2005 | Kulas | 381/384 |
| 2006/0009156 | A1 * | 1/2006 | Hayes et al. | 455/63.1 |
| 2006/0269088 | A1 * | 11/2006 | Julstrom et al. | 381/315 |

FOREIGN PATENT DOCUMENTS

| | | | |
|---|---|---|---|
| EP | 127 1899 | A1 * | 2/2003 |
| GB | 2160075 | A * | 12/1985 |

OTHER PUBLICATIONS

Thompson, Steven C.; "Engineering Acoustics: Compatiability of Hearing Aids and Cellular Telephones: Standards Progress"; Nov. 2, 1999; J. Acoust. Soc. Am; vol. 106, No. 4, Pt. 2; pp. 2137-2138.*
Global Coils, Audiocoil Products, Passive Coils with Leads, Technical Data Sheet, Rev: 20031010-1 (3 pages).
Siemens Hearing Instruments, PHOENIX™ Essential Digital Technology Brochure, 2004 (5 pages).

* cited by examiner

*Primary Examiner*—Suhan Ni
*Assistant Examiner*—Ryan C Robinson
(74) *Attorney, Agent, or Firm*—T. Andrew Currier; Stephen J. Perry; Perry + Currier Inc.

(57) ABSTRACT

A peripheral for an electronic device having a speaker is provided. The peripheral includes an input device for placement proximal to the speaker for receiving audio information from the speaker. The peripheral includes an output device connected to the input device that is positioned distal from the input device and away from electromagnetic signals generated by the device. The output device presents the audio information to a hearing aid proximal to the output device. The output device is positioned at a distance such that the electromagnetic signals experienced by the input device is less than the signals experienced by the hearing aid. As a result, deleterious effects of signals otherwise experienced by the hearing aid are reduced.

13 Claims, 8 Drawing Sheets

AUDIO PERIPHERAL FOR AN ELECTRONIC DEVICE

FIELD OF THE INVENTION

The present invention relates generally to electronic devices and more particularly relates to an audio peripheral for an electronic device such as a wireless telephone.

BACKGROUND OF THE INVENTION

Prostheses can be an important part of providing greater physical independence for individuals who have physical impairments. For those with hearing impairments, a hearing aid can assist in allowing an individual to enjoy a lifestyle with similar benefits to those without such impairments.

Quite apart from the field of prosthetics, in general, electronic devices are becoming ubiquitous. Indeed, the functionality originally separately found in wireless telephones, wireless paging devices, wireless email devices, wireless text message devices ("wireless communication devices") is increasingly being integrated into a single enhanced electronic device ("EED") that also includes the functionality of a traditional personal digital assistant ("PDA"). Digital still cameras, digital video cameras, digital video players and digital audio players are ripe for integration into a single EED. Yet, with an aging population that is increasingly reliant on EEDs, considerations for those with physical impairments, including hearing impairments, are a factor when developing an EED.

Indeed, the Federal Communication Commission ("FCC") of the United States of America ("USA") has recently ruled that wireless communication devices are no longer exempt from the hearing aid compatibility ("HAC") magnetic coupling requirements of the Americans with Disabilities Act ("ADA"). Compliance with the ADA will mean that wireless devices, including wireless EEDs, will need to produce a magnetic field of a specified strength and frequency response which can be detected by a telephone coil ("telecoil" or "T-coil"), which are now being commonly deployed in hearing aids.

This ruling also specifies that wireless communication devices, including EEDs, also meet certain radio frequency ("RF") interference requirements. However, these RF interference requirements are difficult to meet due to the high RF levels emitted by the EED and the sometimes lack of RF immunity in the hearing aid. One way to ameliorate this problem is to place the EED's antenna as far as possible from the user's hearing aid, by locating the antenna at the bottom of the device. However, depending on the form factor of the device and/or the RF signals associated with operation of the device, merely relocating the antenna will not necessarily suffice.

SUMMARY OF THE INVENTION

It is an object of the present invention to provide a novel audio peripheral for an electronic device that obviates or mitigates at least one of the above-identified disadvantages of the prior art.

BRIEF DESCRIPTION OF THE DRAWINGS

Embodiments will now be described by way of example only, and with reference to the accompanying drawings, in which.

DETAILED DESCRIPTION OF THE INVENTION

Figure 1:
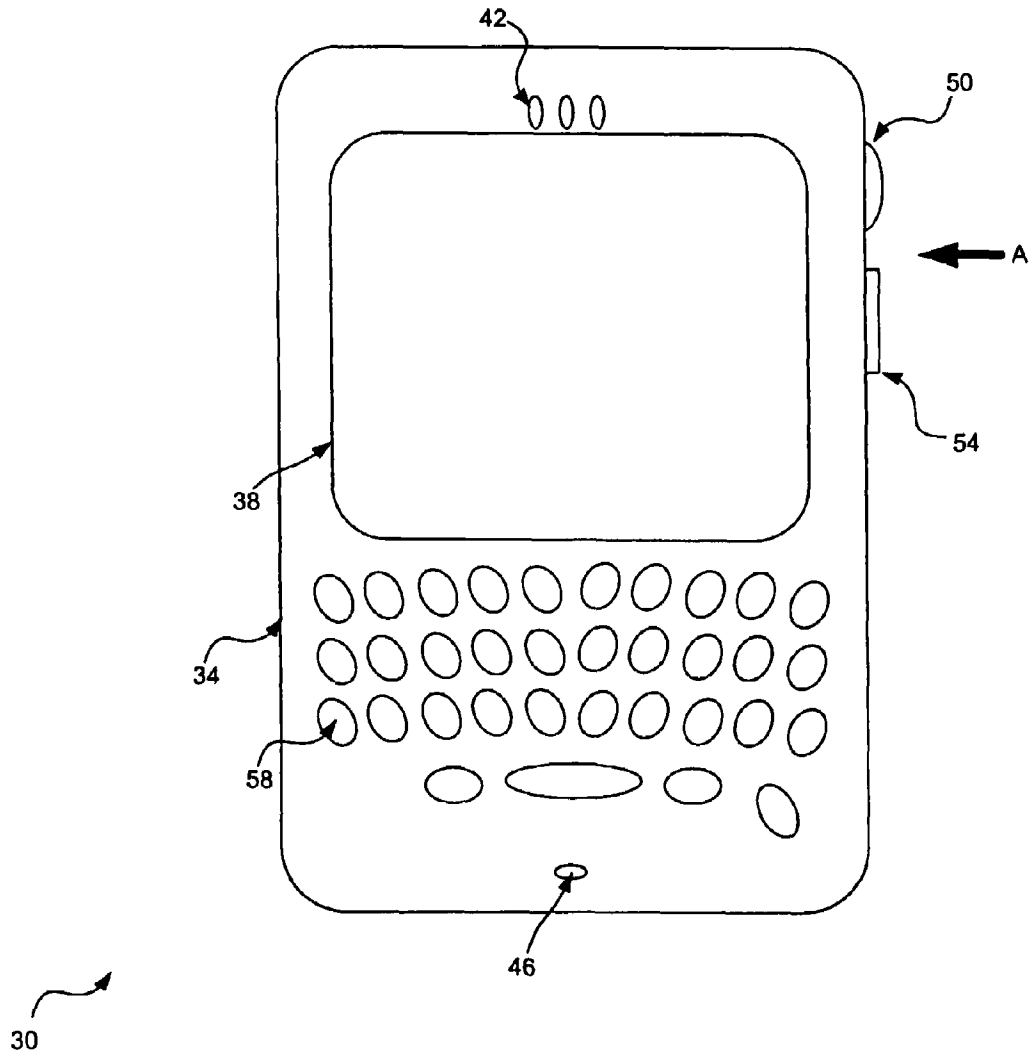
FIG. 1 is a representation of an enhanced electronic device ("EED") that can be used in conjunction with an audio peripheral compatible with a hearing aid.

Referring now to FIG. 1, an enhanced electronic device ("EED") is indicated generally at 30. In the present, and purely exemplary embodiment, device 30 is based on the computing environment and functionality of a personal digital assistant with wireless voice telephony capabilities. However, it is to be understood that device 30 can be based on the construction and functionality of any mobile electronic device that can be connected to a wireless network. Such devices include cellular telephones or laptops computers connected to wireless networks. In a present embodiment, electronic device 30 includes, a housing 34, which frames an LCD display 38, an earpiece 42, a microphone 46, a trackwheel 50, an escape key 54 and a keyboard 58. Trackwheel 50 and escape key 54 can be inwardly depressed along the path of arrow "A" as a means to provide additional user-input. It is to be reiterated that device 30 is purely exemplary and a vast array of other EEDs and configurations thereof are contemplated.

Figure 2:
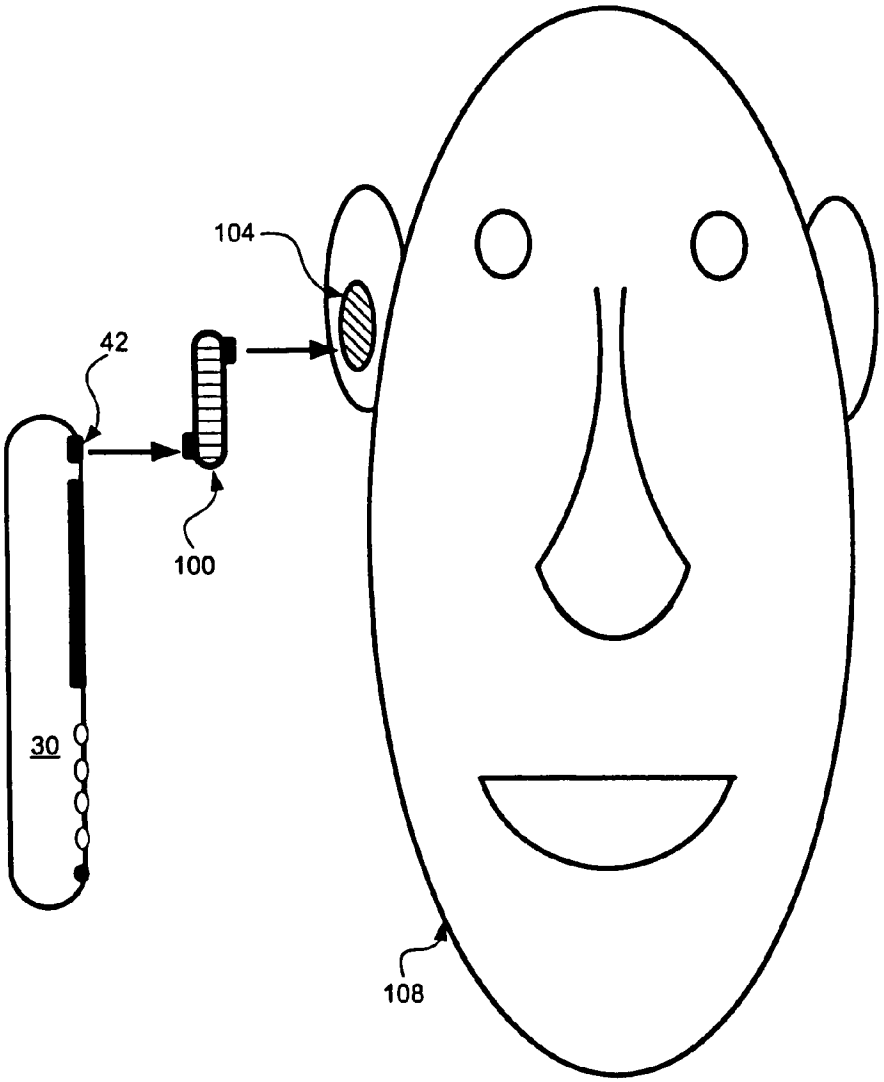
FIG. 2 includes a side view of the device of FIG. 1 shown in conjunction with a representation of an audio peripheral and a hearing aid worn by an individual.
Figure 3:
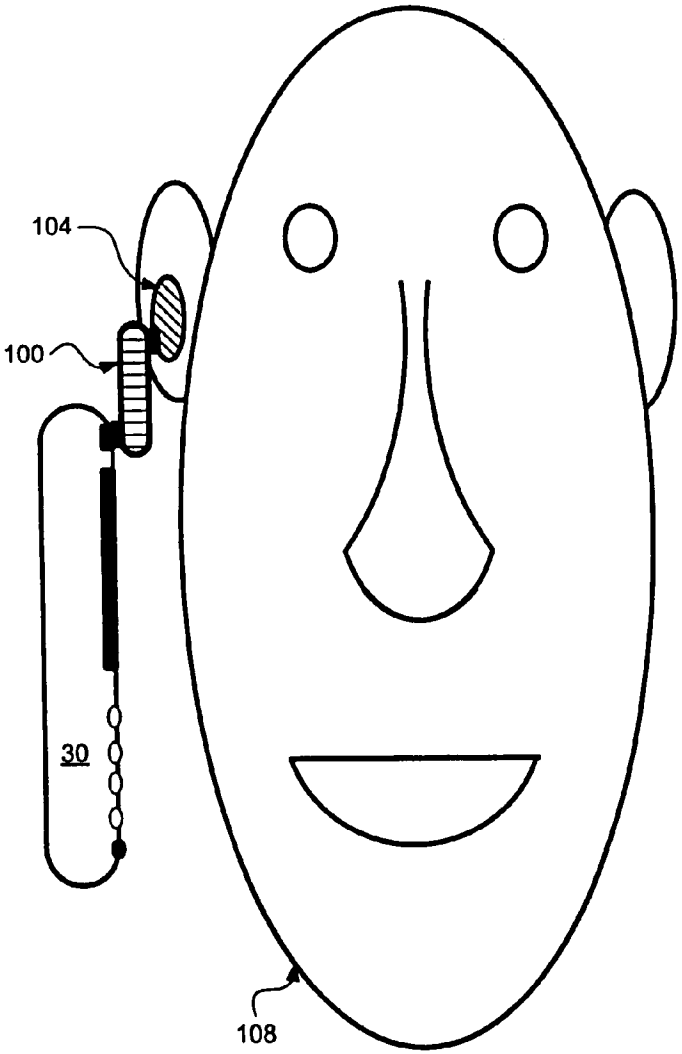
FIG. 3 shows the device, peripheral, hearing aid and individual of FIG. 2, but with the device and peripheral positioned for use by the individual.

Referring now to FIGS. 2 and 3, device 30 is shown in conjunction with an audio peripheral 100 and a hearing aid 104 that is worn by an individual 108. As used herein the term "audio peripheral" can (but does not necessarily) reflect that mechanical sound waves are processed by peripheral 100, but rather, that peripheral 100 relates to the audio function of letting individual 108 "hear" audio signal associated with device 30 and/or hearing aid 104.

In a present embodiment, hearing aid 104 includes a T-Coil. An exemplary model of hearing aid 104 that includes such a T-Coil is the "Phoenix" brand of hearing aid offered by Siemens Hearing Instruments, Inc., P.O. Box 1397, Piscataway, N.J. 08855. As is well understood by those of skill in the art, a T-Coil is, in simple terms, a mechanism incorporated into a hearing aid that can be used in place of a traditional hearing aid microphone to detect a magnetic field associated with an audio signal rather than to detect actual acoustic sound waves to be amplified or otherwise processed for an individual with a hearing impairment.

In hearing aid 104, the microphone of hearing aid 104 can be switched off, and the T-Coil switched on. The T-Coil allows hearing aid 104 to detect the changing magnetic field of an earpiece of a telephone handset, such as earpiece 42 of device 30. Having detected the magnetic field, hearing aid 108 can then generate an audio signal for presentation to the aural canal of individual 108. Such an audio signal can be configured by hearing aid 104 to improve the likelihood of accurate perception of the contents of that audio signal by individual 108.

Figure 4:
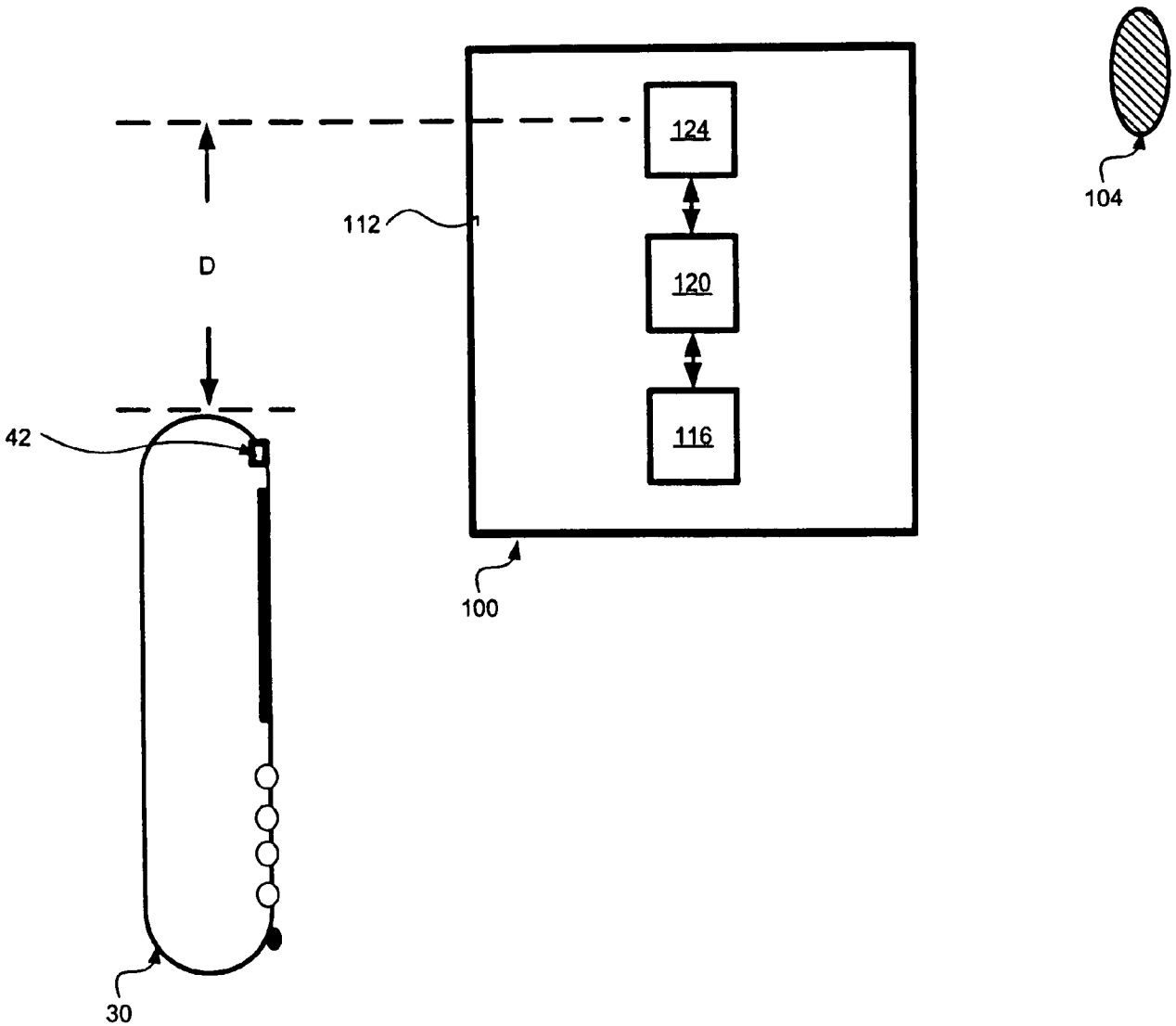
FIG. 4 shows the device, peripheral and hearing aid of FIG. 3 in greater detail, and in particular shows the peripheral in a block diagram format.

Referring now to FIG. 4, a block diagram of peripheral 100 is shown. Peripheral 100 comprises a chassis 112 that houses an input device 116, which in turn is coupled to a shaping circuit 120, and which in turn is coupled to an output device 124. Chassis 112 also typically houses a power supply (not shown), such as a lithium battery to provide electrical energy to the components housed within peripheral 100.

In a present embodiment, input device 116 is a first T-Coil. An exemplary model of such a T-Coil input device is model Y01-31-EFL offered by Global Coils SAGL, Via Ponteggia 2, CH-6814 Lugano-Cadempino, Switzerland. T-Coil input device 116 is thus operable to detect the magnetic field generated by earpiece 42, and deliver a signal representing that detected magnetic field to shaping circuit 120. Shaping circuit 120 can be any type of circuit, computer chip, processor or the like that is operable to shape to the signal delivered from T-Coil input device 116. Such shaping can include, but is not limited to noise filtering, amplification, frequency response shaping, or the like or combinations thereof. The desired shaping, if any, can be selected based on the needs of individual 108 or the functional specifications of hearing aid 104.

Shaping circuit 120, in turn, is operable to present its output to an output device 124. In a present embodiment, output device 124 is a second T-Coil. An exemplary model of such a T-Coil is model Y01-31-EFL offered by Global Coils SAGL, Via Ponteggia 2, CH-6814 Lugano-Cadempino, Switzerland. T-Coil output device 124 is thus operable to present an output magnetic signal representative of the output of earpiece 42. This output magnetic signal is, in turn, presented to the T-Coil in hearing aid 104 for processing by hearing aid 104 in the usual manner. As it will be apparent to those skilled in the art, in another embodiment, T-Coil output device 124 can be different than T-Coil input device 116, where T-Coil output device 124 can, for example, contain a metal core generating a stronger magnetic field for the same current. In another embodiment, the layout, filtering, and shielding of circuit 120 can be adjusted. Also, in yet another embodiment, shaping circuit 120 can be substituted for a circuit to electronically match or buffer input device 116 with the output device 124, providing a gain or a loss.

The form factor of chassis 112 thus also includes some sort of attachment, not shown, in order to mechanically affix peripheral 100 to device 30, such that T-coil input device 116 is proximate to earpiece 42 for ready detection of magnetic signals emitted from earpiece 42. By the same token, the form factor of chassis 112 is also selected so that T-Coil output device 124 can be placed proximate to hearing aid 104 when hearing aid 104 is being worn by individual 108, much in the same manner as a shown in FIG. 3. In effect, peripheral 100 becomes a physical extension of device 30, and T-coil output device 124 is to be positioned proximate to hearing aid 104 in much the same manner that earpiece 42 would be positioned proximate to the ear of an individual in the usual manner to conduct a voice telephone call. Further, and as will be explained in greater detail below, and as represented in FIG. 4, T-Coil output device 124 is physically located a predefined physical distance "D" away from device 30. The overall form factor of chassis 112, and in particular distance D, is chosen so that the electromagnetic interference experienced by hearing aid 104, and caused by the operation of device 30, is reduced.

Figure 5:
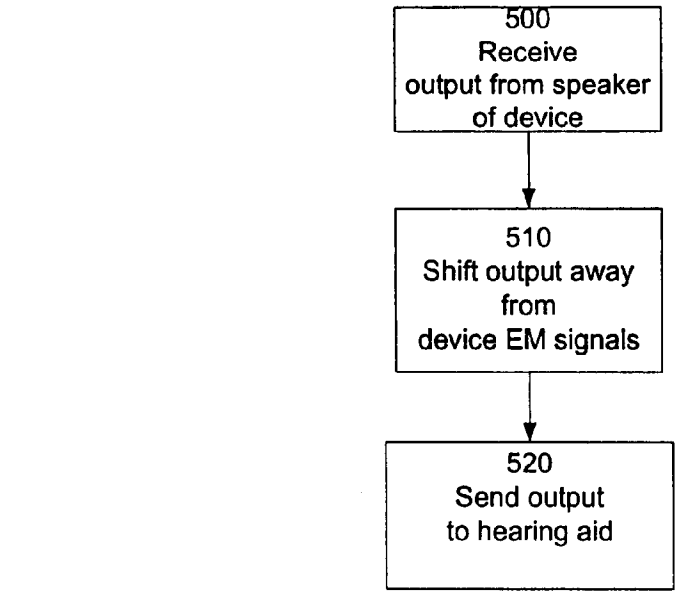
FIG. 5 shows a flow chart depicting a method of presenting audio information to a hearing aid.

A method of presenting audio information to a hearing aid in accordance with another embodiment will now be discussed with reference to the flowchart shown in FIG. 5, and is indicated generally at 500. In order to assist in the explanation of method 500, reference will be made to the foregoing discussion of device 30 and peripheral 100 and hearing aid 104. Such explanation will also assist in further appreciating device 30 and peripheral 100 and hearing aid 104. However, it is to be understood that method 500 and/or device 30 and/or peripheral 100 and/or and hearing aid 104 can be varied, and need not work exactly as described herein.

Before explaining method 500, it will be assumed that device 30, peripheral 100 and hearing aid 104 are "on", and are all being used by individual 108 much in the manner shown in FIG. 3. It will also be assumed that hearing aid 104 is in the "T-Coil" setting. It will also be assumed that audio output is being emitted from earpiece 42. It will also be assumed that electromagnetic signals associated with the regular operation of device 30 are present within the range of device 30.

Figure 6:
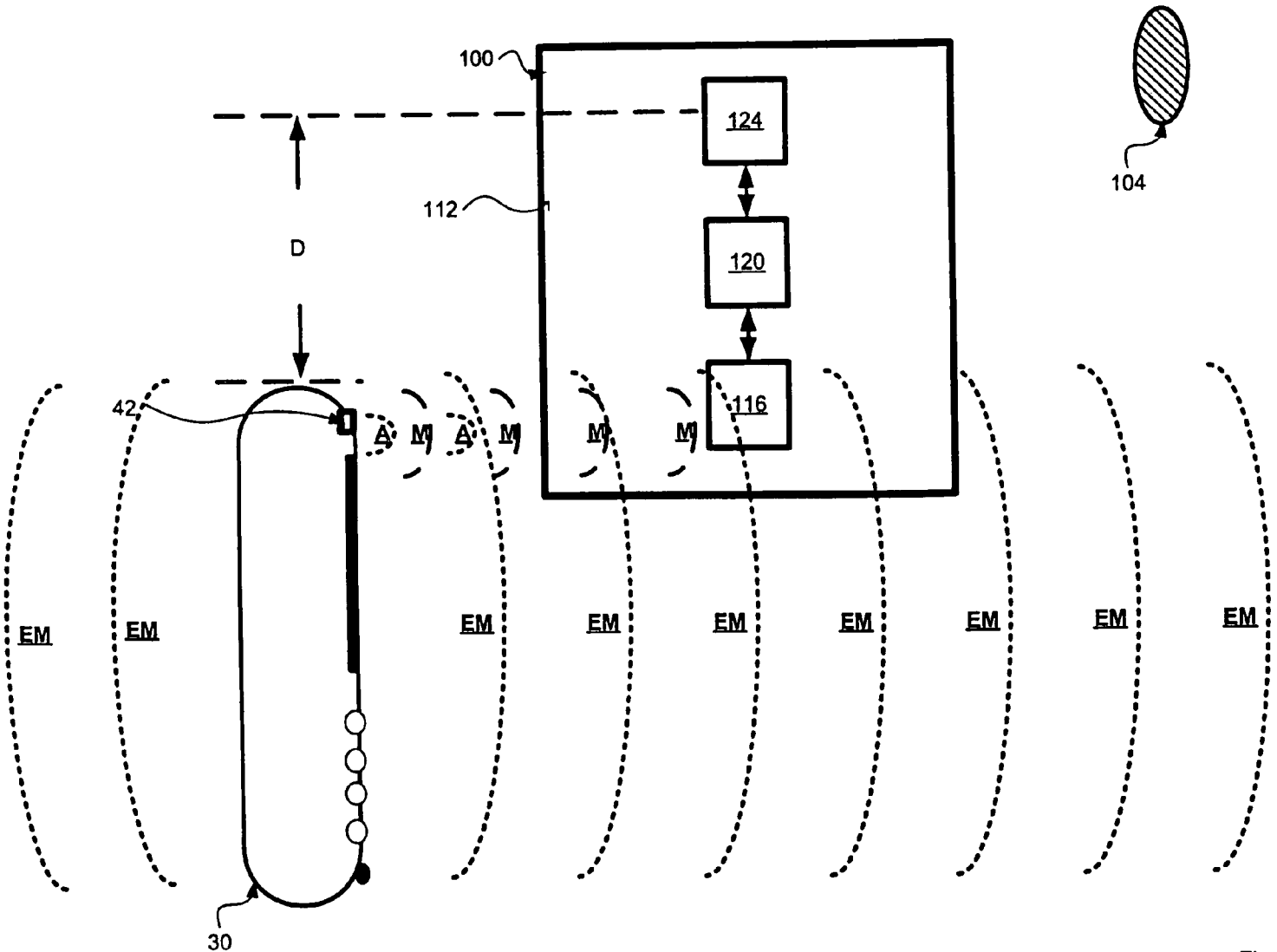
FIG. 6 shows the device, peripheral and hearing aid of FIG. 4 during the performance of the method in FIG. 5.

These assumptions are depicted in FIG. 6. Specifically, FIG. 6 shows audio output indicated at reference "A". Audio output A represents "sound", mechanical vibrations of the air that are detectable as sound to an ear. FIG. 6 also shows magnetic output indicated at reference "M". Magnetic output M represents a magnetic signal that is a representation of audio output A and which is generated by earpiece 42 as earpiece 42 generates audio output A. FIG. 6 also shows electromagnetic signals indicated at reference "EM". Electromagnetic signals EM include all electromagnetic signals EM that are generated as part of the regular operation of device 30, such as the radio communication between device 30 and a wireless base station (not shown) that is present as part of device 30's regular communication functions. Electromagnetic signals EM can also be, however, any electromagnetic noise incidentally emitted by any electrical circuit.

Referring again to FIG. 5, beginning first at step 500, output generated by a speaker of an electronic device is received. When method 500 is performed by peripheral 100, then magnetic output M shown in FIG. 6 is received by T-coil input device 116.

Figure 7:
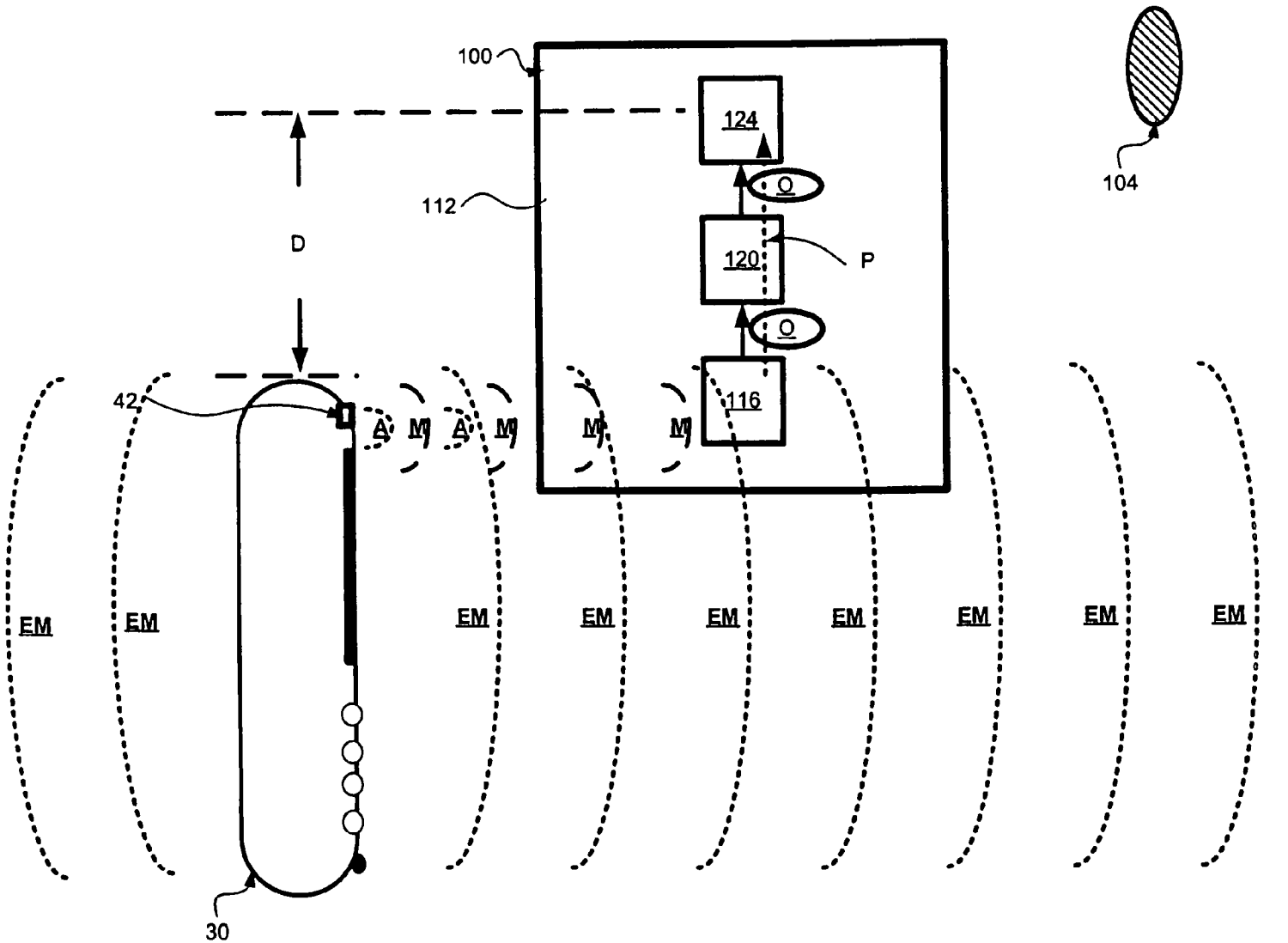
FIG. 7 shows the device, peripheral and hearing aid of FIG. 4 during the performance of the method in FIG. 5; and, FIG. 8 shows the device, peripheral and hearing aid of FIG. 4 during the performance of the method in FIG. 5.

Next, at step 510, the output received at step 500 is shifted away from EM signals. Referring again to the example shown in FIG. 6, it can be seen that electromagnetic signals EM are physically proximal to T-Coil input device 116. The example in FIG. 6 continues in FIG. 7, which represents the performance of step 510. Specifically, the output received at step 500 is represented as an oval indicated at reference "O". Output O is shown travelling along a path P from input device 116, to shaping circuit 120, and finally to output device 124. In this path P, output O is physically shifted away from the source of electromagnetic signals EM by approximately distance D.

(Of note, in this particular example, method 500 is simplified in that it does not contemplate any particular shaping of output O. This simplification is for ease of explanation of method 500. Thus, for this example noise shaping circuit 120 can be omitted altogether from device 30. However, in other examples, shaping circuit 120 can be used to present a shaped version of output O to output device 124, if desired, and so method 500 can be modified to include a step for shaping output O.)

Figure 8:
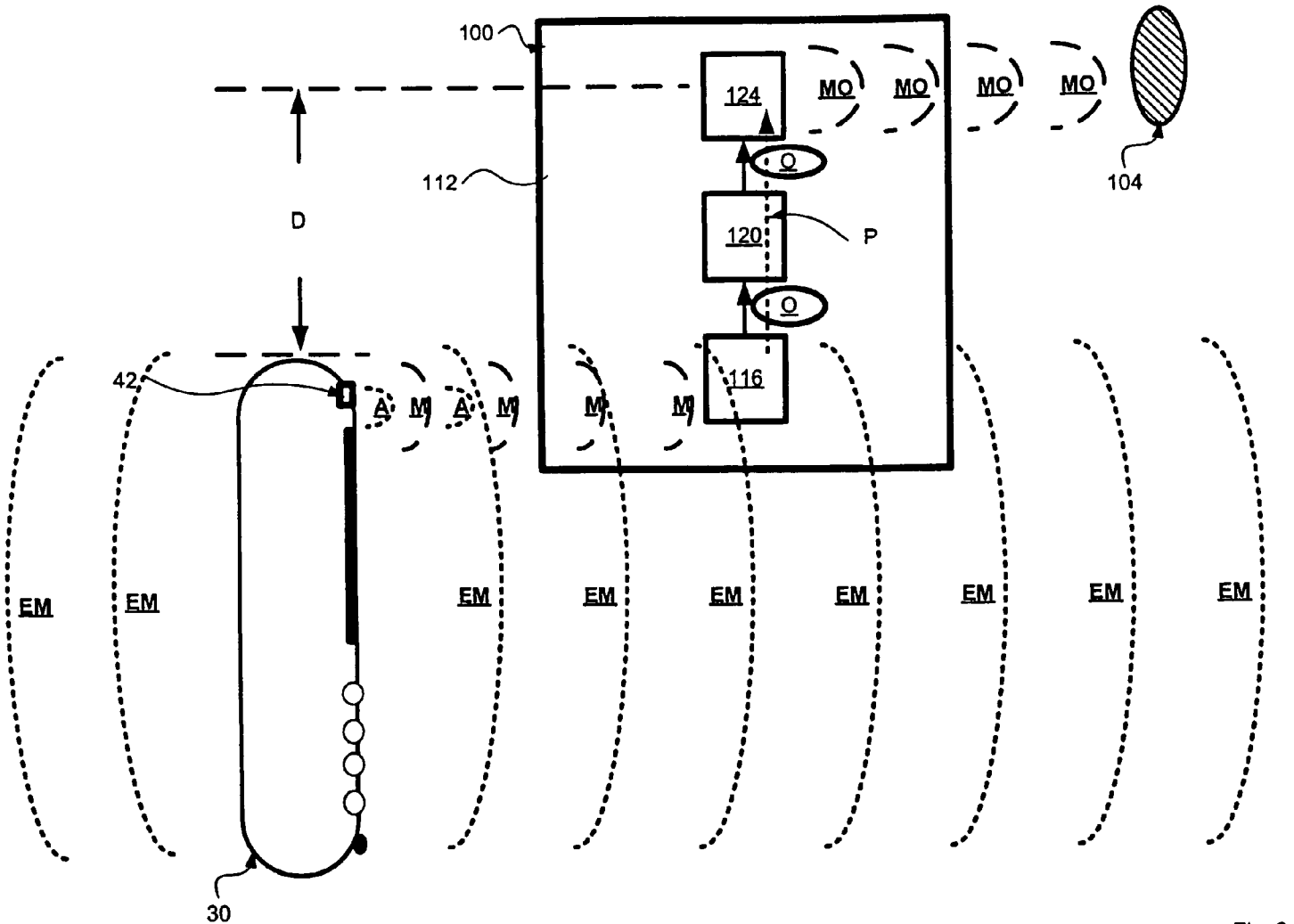

Referring again to FIG. 5, at step 520 output is sent to the hearing aid. Continuing with the example, performance of step 520 is represented in FIG. 8, as T-coil output device 124 is shown emitting magnetic output MO towards hearing aid 104. Thus, since hearing aid 104 is set to the T-coil setting, hearing aid 104 will now receive magnetic output MO and convert it into an audio signal for transmission down the aural canal of individual 108, according the parameters and configuration of hearing aid 104. Also of note, is that output MO is now physically distal from electromagnetic signal EM, such that method 500 and peripheral 100 have the effect of allowing hearing aid 104 to receive a representation of magnetic output M, but reducing and/or eliminating the presence of electromagnetic signal EM at hearing aid 104, and likewise reducing and/or eliminating the adverse effects caused by electromagnetic signal EM. As a result, deleterious effects of electromagnetic signal EM on the functionality of hearing aid 104 are reduced.

Thus, the distance D can be chosen to be a distance large enough to reduce and/or prevent the experience of electromagnetic signal EM at hearing aid 104. The distance D need only be enough to allow hearing aid 104 to deliver an audio signal down the aural canal of individual 108 that can be meaningfully interpreted by individual 108. However, distance D can also be chosen to dramatically improve the overall sound quality from hearing aid 104 that is experienced by individual 108. At the same time, distance D is chosen so that it is not so large that the ergonomic handling of device 30 becomes impractical. Additionally, distance D can be chosen so that the form factor of peripheral 100 is not impractically large to carry or store.

In addition to, or in lieu of other factors, the choice of the distance D can also be based on the characteristics of the communications protocol used by device 30. For example, device 30 can use Global System for Mobile Communication (GSM) or Code Division Multiple Access (CDMA), amongst others, to communicate with a base station. Depending on the particular protocol used, the distance D can be chosen to reduce the experience of electromagnetic signal EM at hearing aid 104. For example, typically, a larger distance D can be chosen for a GSM based device 30 than a CDMA based device 30. Moreover, the particular radio frequency used can also guide the choice of the distance D. For example, a GSM based device 30 can be operated at the 850, 900, 1800 and 1900 MHz frequencies, amongst others, (or combinations thereof) depending on the particular geographic location. Larger distances D can typically be chosen for lower frequencies to reduce the experience of electromagnetic signal EM at hearing aid 104.

In a present embodiment, a distance D between about two and about six centimeters reduces the experience of electromagnetic signal EM at hearing aid 104, regardless of whether device 30 is based on GSM, or CDMA. In a presently preferred embodiment, the distance D is between about 2.5 centimeters and about 5.5 centimeters. In a still more presently preferred embodiment the distance D is between about three and about five centimeters.

While only specific combinations of the various features and components of the present invention have been discussed herein, it will be apparent to those of skill in the art that desired subsets of the disclosed features and components and/or alternative combinations of these features and components can be utilized, as desired. For example, while input device 116 was a T-coil, input device 116 could simply be a microphone capable of detecting audio signals A. By the same token, output device 124 can simply be a speaker that emits an audio signal that is processed by hearing aid 104 when hearing aid 104 does not have a T-Coil, or does not have its T-Coil activated. Combinations of the two foregoing variations, and the previous variations, are also contemplated. Whichever combination of T-Coils, microphones, and/or speaker's are chosen for peripheral 100, so too can shaping circuit 120 be modified in order to provide desired noise shaping, if any.

As another example, peripheral 100 can be used on other devices, such as cellular telephones, or audio players that have an external speaker akin to earpiece 42.

As another example, peripheral 100 can be integrally built into device 30, in the way a retractable antenna can be deployed in an electronic device. Peripheral 100 can be deployed or retracted as desired. In this variation, on deployment, then input device 116 can be integrated into earpiece 42, and/or earpiece 42 and device 116 merged into a single component. Such a single component would behave as an earpiece when the peripheral is retracted, but behave as input device 116 when the peripheral is deployed.

The above-described embodiments of the invention are intended to be examples of the present invention and alterations and modifications may be effected thereto, by those of skill in the art, without departing from the scope of the invention which is defined solely by the claims appended hereto.

The invention claimed is:

1. A peripheral for use with a hearing aid having a T-coil and an electronic device having a speaker for generating audio signals; said electronic device operable to emit electromagnetic signals; said peripheral comprising:

an input device in the form of a first T-coil for receiving a magnetic signal output from said electronic device when said input device is proximate to said speaker;

an output device in the form of a second T-coil operably connected to said input device and for sending a representation of said magnetic signal output to said hearing aid when said hearing aid is proximate to said output device; said output device positioned between about two and about six centimeters apart from said input device, such that said electromagnetic signals experienced by said hearing aid are less than said electromagnetic signals experienced by said input device.

2. The peripheral of claim 1 further comprising a shaping circuit between said input device and said output device for shaping a signal representing said magnetic signal output as said signal is delivered from said input device to said output device.

3. The peripheral of claim 2 wherein said shaping circuit is operable to perform at least one of noise filtering, amplification and frequency response shaping.

4. The peripheral of claim 1 wherein said device includes the functionality of a cellular telephone and said electromagnetic signals includes signals associated with communications between said device and a wireless base station.

5. The peripheral of claim 1 wherein said output device is positioned between about 2.5 and about 5.5 centimeters apart from said input device.

6. The peripheral of claim 1 wherein said output device is positioned between about three and about five centimeters apart from said input device.

7. The peripheral of claim 1 further including a mechanical attachment for removably affixing said peripheral to said electronic device.

8. A method of presenting audio information from an electronic device to a hearing aid having a T-coil; said electronic device having a speaker for generating audio signals; said electronic device also producing electromagnetic signals; said method comprising the steps of:

receiving at an input device in the form of a first T-coil a magnetic signal output from said speaker; and providing said magnetic signal output to an output device in the form of a second T-coil, said output device being placed at a location proximate to said hearing aid that is a predefined distance of between about two and about six centimeters from said electronic device; and transmitting a representation of said magnetic signal output to said hearing aid from said output device, such that a first level of said electromagnetic signals experienced at said hearing aid is less than a second level of said electromagnetic signals experienced at said speaker.

9. The method of claim 8 further comprising the step of shaping said output information intermediate said receiving step and said transmitting step.

10. The method of claim 9 wherein said shaping step comprises at least one of noise filtering, amplification and frequency response shaping.

11. The method of claim 8 wherein said device includes the functionality of a cellular telephone and said electromagnetic signals include signals associated with communications between said device and a wireless base station.

12. The method of claim 8 wherein said predefined distance is between about 2.5 centimeters and about 5.5 centimeters.

13. The method of claim 8 wherein said predefined distance is between about three centimeters and about five centimeters.

* * * * *